US010207508B2

(12) United States Patent
Chen et al.

(10) Patent No.: US 10,207,508 B2
(45) **Date of Patent: *Feb. 19, 2019**

(54) PRINTHEAD CARTRIDGE MOLDED WITH NOZZLE HEALTH SENSOR

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US); Brett E. Dahlgren, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/704,483

(22) Filed: Sep. 14, 2017

(65) Prior Publication Data

US 2018/0001642 A1 Jan. 4, 2018

Related U.S. Application Data

(63) Continuation of application No. 15/111,878, filed as application No. PCT/US2014/013713 on Jan. 30, 2014, now Pat. No. 9,770,909.

(51) Int. Cl.

| | |
|---|---|
| ***B41J 2/165*** | (2006.01) |
| ***B41J 2/14*** | (2006.01) |
| ***B41J 2/16*** | (2006.01) |

(52) U.S. Cl.

CPC ..... *B41J 2/16579* (2013.01); *B41J 2/1404* (2013.01); *B41J 2/14032* (2013.01);

(Continued)

(58) Field of Classification Search

CPC .. B41J 2/16579; B41J 2/14032; B41J 2/1603; B41J 2/1404; B41J 2/1637; B41J 2002/14354

See application file for complete search history.

(56) References Cited

U.S. PATENT DOCUMENTS

| | | | |
|---|---|---|---|
| 6,692,099 | B2 | 2/2004 | Rio Doval |
| 6,984,013 | B2 | 1/2006 | Arqullevich et al. |

(Continued)

FOREIGN PATENT DOCUMENTS

| | | |
|---|---|---|
| WO | WO-2012030344 | 3/2012 |
| WO | WO-2014133517 | 9/2014 |

(Continued)

OTHER PUBLICATIONS

Korean Intellectual Property Office, International Search Report and Written Opinion for PCT/US2014/013713 dated Oct. 15, 2014 (12 pages).

(Continued)

*Primary Examiner* — Yaovi M Ameh

(74) *Attorney, Agent, or Firm* — HP Inc.—Patent Department

(57) ABSTRACT

In some examples, a print cartridge includes a monolithic molding, and a printhead die embedded into a molding. The printhead die has a front surface exposed outside the molding to dispense fluid drops through nozzles and an opposing back surface covered by the molding except at a channel in the molding through which fluid is to pass directly to the back surface. The printhead die also has a nozzle health sensor molded into the molding to detect defective nozzles in the printhead die.

20 Claims, 7 Drawing Sheets

(52) U.S. Cl.
CPC ..... *B41J 2/1603* (2013.01); *B41J 2/1637* (2013.01); *B41J 2002/14354* (2013.01)

(56) References Cited

U.S. PATENT DOCUMENTS

| | | | | |
|---|---|---|---|---|
| 7,246,874 | B2 | 7/2007 | Hirakata et al. | |
| 7,287,824 | B2 | 10/2007 | Subirada | |
| 7,909,428 | B2 | 3/2011 | Donaldson et al. | |
| 9,770,909 | B2 * | 9/2017 | Chen | B41J 2/14032 |
| 2001/0043245 | A1 | 11/2001 | Endo et al. | |
| 2002/0085057 | A1 | 7/2002 | Endo | |
| 2004/0189758 | A1 | 9/2004 | Alexia | |
| 2005/0146550 | A1 | 7/2005 | Kusakari | |
| 2006/0066659 | A1 | 3/2006 | Giovanola | |
| 2006/0170733 | A1 | 8/2006 | Lee et al. | |
| 2006/0268035 | A1 | 11/2006 | Lee | |
| 2007/0024658 | A1 | 2/2007 | Diol et al. | |
| 2008/0225069 | A1 * | 9/2008 | Miyazawa | B41J 2/04561 347/14 |
| 2009/0058897 | A1 | 3/2009 | Han et al. | |
| 2009/0058921 | A1 * | 3/2009 | Habashi | B41J 2/16585 347/29 |
| 2010/0259753 | A1 | 10/2010 | Shepherd et al. | |

FOREIGN PATENT DOCUMENTS

| | | |
|---|---|---|
| WO | WO-2014133575 | 9/2014 |
| WO | WO-2014133577 | 9/2014 |
| WO | WO-2014133578 | 9/2014 |

OTHER PUBLICATIONS

Trondle et al.; Non-contact Optical Sensor to Detect Free Fying Droplets in the Nanolitre Range; Sensors and Actuators A 158; Feb. 11, 2010; pp. 254-262.

* cited by examiner

PRINTHEAD CARTRIDGE MOLDED WITH NOZZLE HEALTH SENSOR

CROSS REFERENCE TO RELATED APPLICATIONS

This is a continuation of U.S. application Ser. No. 15/111,878, having a national entry date of Jul. 15, 2016, which is a national stage application under 35 U.S.C. § 371 of PCT/US2014/013713, filed Jan. 30, 2014, which are both hereby incorporated by reference in their entirety.

BACKGROUND

Inkjet printers produce text and images on paper and other print media through drop-on-demand ejection of fluid ink drops using inkjet nozzles. However, when the nozzles become clogged they can stop operating correctly and cause visible print defects in the printed output. Such print defects are commonly referred to as missing nozzle print defects.

In printers that employ multi-pass print modes (e.g., scanning a print cartridge back and forth across the media), missing nozzle defects can be addressed by passing an inkjet printhead over the same section of a media page multiple times. This provides an opportunity for several nozzles to jet ink onto the same portion of a page to minimize the effect of one or more missing nozzles. Another way to address missing nozzle defects is through speculative nozzle servicing. Here, the printer causes a printhead to eject ink into a service station to exercise nozzles and ensure their future functionality, regardless of whether the nozzles would have produced a print defect.

In printers that employ single-pass print modes (e.g., media passing one time under a page-wide printhead array), missing nozzle defects have been addressed using redundant printhead nozzles that can mark the same area of a media page as a defective nozzle, or by servicing the defective nozzle to restore it to full functionality. However, the success of these solutions, particularly in the single-pass print modes, relies on a timely identification of the missing or defective nozzles.

BRIEF DESCRIPTION OF THE DRAWINGS

The present embodiments will now be described, by way of example, with reference to the accompanying drawings, in which.

DETAILED DESCRIPTION

Overview

Figure 1:
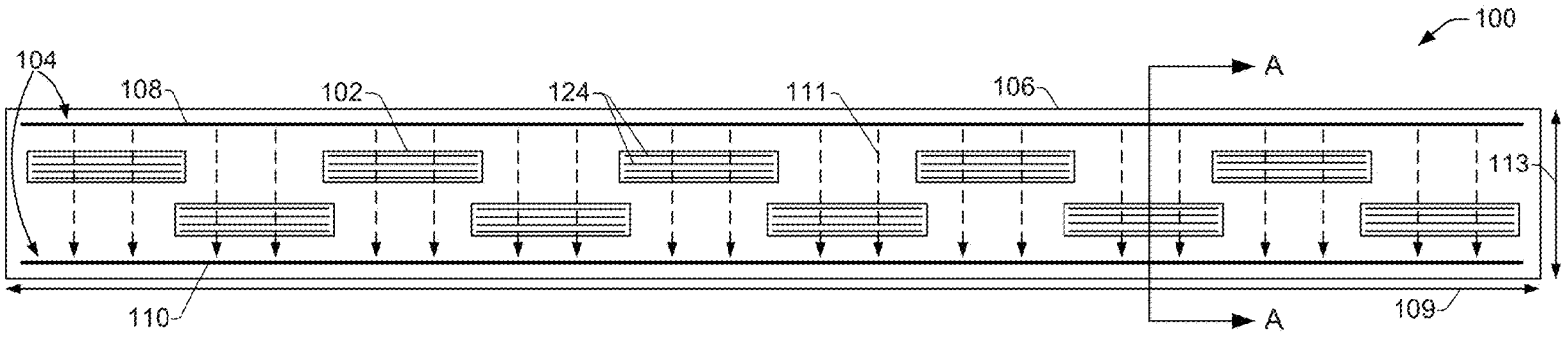
FIG. 1 shows a plan view of an example of a molded inkjet print bar having multiple printhead dies and a nozzle health sensor.

Conventional inkjet printheads incorporate integrated circuitry (e.g., thermal heating and drive circuitry) with fluidic structures including fluid ejection chambers and nozzles onto the same silicon die substrate. A fluid distribution manifold (e.g., a plastic interposer or chiclet) and slots formed in the die substrate, together, provide fluidic fan-out from the microscopic ejection chambers on the front surface of the die to larger ink supply channels at the back surface of the die. However, the die slots occupy valuable silicon real estate and add significant slot processing costs. While a smaller, less costly silicon die can be achieved by using a tighter slot pitch, the costs associated with integrating the smaller die with a fan-out manifold and inkjet pen more than offset the benefit of the less costly die.

Ongoing efforts to reduce inkjet printhead costs have given rise to new, molded inkjet printheads that break the connection between the size of the die needed for the ejection chambers and the spacing needed for fluidic fan-out. The molded inkjet printheads enable the use of tiny printhead die "slivers" such as those described in international patent application numbers PCT/US2013/046065, filed Jun. 17, 2013 titled Printhead Die, and PCT/US2013/028216, filed Feb. 28, 2013 titled Molded Print Bar, each of which is incorporated herein by reference in its entirety. Methods of forming the molded inkjet printheads and molded print bars include, for example, compression molding and transfer molding methods such as those described, respectively, in international patent application numbers PCT/US2013/052512, filed Jul. 29, 2013 titled Fluid Structure with Compression Molded Fluid Channel, and PCT/US2013/052505, filed Jul. 29, 2013 titled Transfer Molded Fluid Flow Structure, each of which is incorporated herein by reference in its entirety.

Emerging inkjet printing markets (e.g., high-speed large format printing) call for high page throughput and improved print quality. This performance is achievable using molded inkjet printheads and/or molded print bars within page-wide array printers that operate in single-pass printing modes. However, like conventional inkjet printheads, molded inkjet printheads and print bars can encounter missing nozzle print defects that cause visible print defects in printed output. This is particularly true in page-wide array printing devices implementing single-pass print modes, because the ability to pass the inkjet printheads or print bars over a section of a page multiple times normally does not exist.

In general, page-wide array printing devices employing single-pass print modes incorporate a significantly larger number of print nozzles than devices employing multi-pass print modes. The large number of nozzles allows for redundant nozzles that can be used to mitigate missing nozzle print defects by marking areas on a media page that a missing or defective nozzle may fail to mark. However, effective mitigation of missing nozzle defects using redundant nozzles relies on a timely identification of the missing nozzles.

Example implementations of molded inkjet printheads described herein include nozzle health sensors integrated into a molding with small printhead die "slivers" to form monolithic molded print bars and printheads. The nozzle health sensors can include, for example, LED illuminators and CMOS imaging sensors molded into the print bars. In one implementation, optics molded into a print bar direct light from an LED across the print bar toward an imaging sensor. Fluid drops ejected from nozzles in the print bar are detected by the imaging sensor as they pass through and block out portions of the light from the LED. Conversely, missing fluid drops are also detected when the imaging sensor senses light from the LED at locations and times where fluid drops are expected to block the light. That is, a missing fluid drop is detected if light is sensed where it should be blocked by a fluid drop. Detection of a missing fluid drop provides an indication of a defective (e.g., clogged) nozzle. In another implementation, an imaging sensor integrated into the monolithic print bar molding examines dots on the paper or other media to detect when dots are missing. Here, by way of example, an imaging sensor can comprise a scanner that includes a light source to illuminate the page and a detector to sense light reflected off the page and determine where dots are present and where dots are missing.

In one example, a printhead includes a printhead die molded into a molding. The die has a front surface exposed outside the molding to dispense fluid drops through nozzles and an opposing back surface covered by the molding except at a channel in the molding through which fluid may pass directly to the back surface. The die also has a nozzle health sensor molded into the molding to detect defective nozzles in the printhead die.

In another example, a print bar includes multiple printhead dies embedded in a molding. The dies are arranged generally end to end along a length of the molding in a staggered configuration in which one or more of the dies overlaps an adjacent one or more of the dies. The print bar also includes a nozzle health sensor molded into the molding to determine an absence of fluid drops that are expected to be ejected from the printhead dies.

In another example, a print cartridge includes a housing to contain a printing fluid and a printhead. The printhead includes a printhead die embedded in a molding. The back surface of the die is covered by the molding and the exposed front surface has nozzles to eject fluid drops. The molding is mounted to the housing and has a channel that fluid can pass through to the back surface of the die. The printhead includes a nozzle health sensor molded into the molding to detect defective nozzles in the printhead die.

As used in this document, a "printhead" and a "printhead die" mean the part of an inkjet printer or other inkjet type dispenser that can dispense fluid from one or more nozzle openings. A printhead includes one or more printhead dies. A die "sliver" means a printhead die with a ratio of length to width of 50 or more. A printhead and printhead die are not limited to dispensing ink and other printing fluids, but instead may also dispense other fluids for uses other than printing.

Illustrative Embodiments

FIG. 1 shows a plan view of an example of a molded inkjet print bar 100 having multiple "sliver" printhead dies 102 and a nozzle health sensor 104 molded into a monolithic print bar molding 106. The molded inkjet print bar 100 is suitable for use, for example, within a page-wide array inkjet printing device that operates in a single-pass printing mode. However, while much of the following discussion relates to the integration of a nozzle health sensor 104 within a molded inkjet print bar 100 for use in a page-wide array inkjet printing device, the concepts apply in a similar manner to the integration of such a sensor 104 within a molded printhead for use in a scanning inkjet printing device, as discussed below with reference to FIGS. 8-11.

The molding 106 generally forms a monolithic body of plastic, epoxy mold compound, or other moldable material. The nozzle health sensor 104 molded into molding 106 includes an illumination array 108 and a detection array 110. By way of example, the illumination array 108 can include an array of LEDs (light emitting diodes) or other illuminators molded into the molding 106 and extending along the length 109 of the print bar 100 and molding 106. Thus, illumination array 108 can include a linear array of LEDs, for example. Similarly, the detection array 110 can include an array of photosensitive elements, or imaging sensors such as CCD (charge coupled device) imaging sensors or CMOS (complementary metal oxide semiconductor) imaging sensors molded into the molding 106 and extending along the length 109 of the print bar 100 and molding 106. Thus, detection array 110 can include a linear array of CCD or CMOS imaging sensors, for example.

This configuration enables light from the illumination array 108 (e.g., represented by dashed arrows 111) to be optically directed across the width 113 of the print bar 100 and across the nozzles 124 (FIG. 2) at the front surface 117 of each of the printhead dies 102. The light 111 is further optically directed to the detection array 110 where it is sensed. As discussed below with respect to FIGS. 2 and 3, defective nozzles 124 in the printhead dies 102 that fail to eject fluid drops in an expected manner can be detected when light from the illumination array 108 that would otherwise be blocked by an expected fluid drop is instead sensed by the detection array 110.

Figure 2:
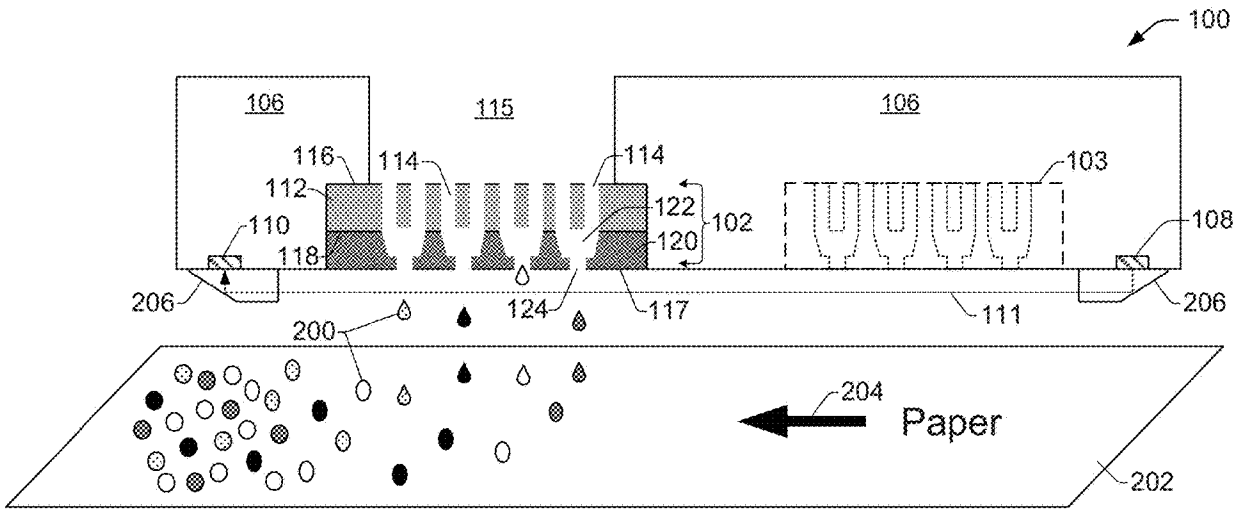
FIG. 2 is an elevation section view taken across line A-A of FIG. 1, showing an example molded inkjet print bar with details of a nozzle health sensor and a printhead die.

FIG. 2 is an elevation section view taken across line A-A of FIG. 1, showing additional details of an example illumination array 108, detection array 110, and printhead die 102, integrated into the molding 106 of a molded inkjet print bar 100. Note that dashed lines 103 are provided to illustrate additional printhead dies 102 elsewhere within the molded print bar 100 that are not intersected by the section view taken across line A-A of FIG. 1. Each printhead die 102 is molded into the molding 106 such that a front surface 117 of the die 102 is exposed outside of the molding 106, enabling nozzles 124 in the die to dispense fluid drops 200. The die 102 has an opposing back surface 116 that is covered by the molding 106, except at a channel 115 formed in the molding 106 through which fluid may pass directly to the die 102. Each die 102 in print bar 100 can have a separate fluid channel 115 formed through the molding 106 to enable the ejection of different types of fluids (e.g., different ink colors) from the print bar 100. Each fluid channel 115 comprises an elongated channel positioned at the back surface 116 of a corresponding one of the printhead dies 102. Channels 115 can be formed by various methods including saw cutting the channels, molding the channels, and etching the channels.

Each printhead die 102 in the molded print bar 100 includes a silicon die substrate 112 comprising a thin silicon sliver on the order of 100 microns in thickness. The silicon substrate 112 includes fluid feed holes 114 dry etched or otherwise formed therein to enable fluid to flow from channel 115, through the substrate 112 from a first substrate surface 116 (i.e., the back surface 116 of the die 102) to a second substrate surface 118. In some examples, the silicon substrate 112 may also include a thin silicon cap (e.g., a cap on the order of 30 microns in thickness over the silicon substrate 112; not shown) adjacent to and covering the first substrate surface 116 (i.e., the back surface 116 of the die).

Formed on the second substrate surface 118 are one or more layers 120 that define a fluidic architecture that facilitates the ejection of fluid drops 200 from the printhead die 102. The fluid drops 200 are directed onto print media 202 (e.g., paper) as it travels under the print bar 100 in a perpendicular direction 204. The fluidic architecture defined by layer(s) 120 generally includes ejection chambers 122, each having corresponding nozzles 124, a manifold (not shown), and other fluidic channels and structures. The layer(s) 120 can include, for example, a chamber layer formed on the substrate 112 and a separately formed nozzle layer over the chamber layer, or, they can include a single monolithic layer 120 that combines the chamber and nozzle layers. The fluidic architecture layer 120 is typically formed of an SU8 epoxy or other polyimide material, and can be formed using various processes including a spin coating process and a lamination process.

In addition to the fluidic architecture defined by layer(s) 120 on silicon substrate 112, the printhead die 102 includes integrated circuitry formed on the substrate 112 using thin film layers and elements not shown in FIG. 2. For example, corresponding with each ejection chamber 122 is a thermal ejection element or a piezoelectric ejection element formed on substrate 112. The ejection elements are actuated to eject drops 200 or streams of ink or other printing fluid from chambers 122 through nozzles 124. Ejection elements on printhead die 102 are connected to bond pads or other suitable electrical terminals (not shown) on printhead die 102 directly or through substrate 112.

As noted above, light 111 from illumination array 108 is optically directed across the nozzles 124 at the front surface 117 of each printhead die 102 and detected by the detection array 110. One or more optical components 206 associated with the illumination and detection arrays help to align light 111 from the illumination array 108 and focus it for detection by the detection array 110. For example, optical components 206 associated with illumination array 108 may receive a point illumination source of light from an LED within the illumination array 108 and alter the point illumination into a line illumination directed across the nozzles 124 at the front surface 117 of a printhead die 102. Additional optical components 206 associated with the detection array 110 direct and/or focus the light from the illumination array 108 onto the detection array 110. Optical components 206 can include, for example, one or more of a collimator, a curved mirror, a lens, combinations thereof, and so on.

Optical components 206 are generally positioned outside, or above, the surface of the print bar molding 106 to facilitate the communication of light 111 between the illumination array 108 and detection array 110. The optical components 206 can be integrated into the molded print bar 100 in a number of ways. For example, they can be part of an assembly that includes the illumination array 108 and/or detection array 110. Thus, an illumination assembly (e.g., comprising an illumination array 108 and one or more optical components 206), a detection assembly (e.g., comprising a detection array 110 and one or more optical components 206), and the printhead dies 102, can all be molded within the print bar molding 106 during a single molding process. The optical components 206 might also be separate components that are molded onto the print bar molding 106 during a subsequent, secondary molding process that employs a clear/transparent epoxy compound to enable the passage of light 111. In another example, separate attachment fixtures can be molded into the print bar molding 106 to which the optical components 206 are subsequently affixed. In yet another example, the optical components 206 can be adhered to the print bar molding 106 using an adhesive material.

Figure 3:
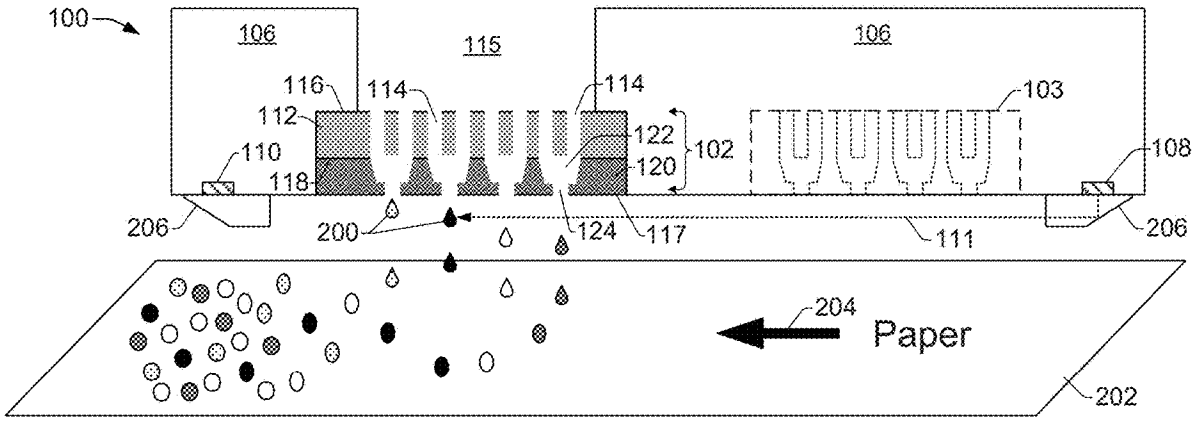
FIG. 3 is an elevation section view taken across line A-A of FIG. 1, showing an example molded inkjet print bar with one or more fluid drops passing through the light emitted by an illumination array.

When fluid drops 200 pass through and block light 111 from illumination array 108, the absence of light is detected by detection array 110. As shown in FIG. 2, there are no drops 200 passing through the light 111. In this circumstance, all of the light 111 being emitted from the illumination array 108 along the length of the print bar 100 makes it across the print bar 100 and is detected by the detection array 110. As shown in FIG. 3, one or more fluid drops 200 are passing through the light 111, which blocks some of the light from being sensed by the detection array 110. Note that FIGS. 2 and 3 show views of the print bar 100 taken across line A-A of FIG. 1, and that the light 111 shown in FIGS. 2 and 3 is therefore a side view of all of the light being emitted by the illumination array 108 up and down the length of the print bar 100. Thus, while FIG. 3 shows light 111 being blocked by a fluid drop 200, other light is also being emitted by illumination array 108 both behind and in front of the blocked light shown in FIG. 3.

Figure 4:
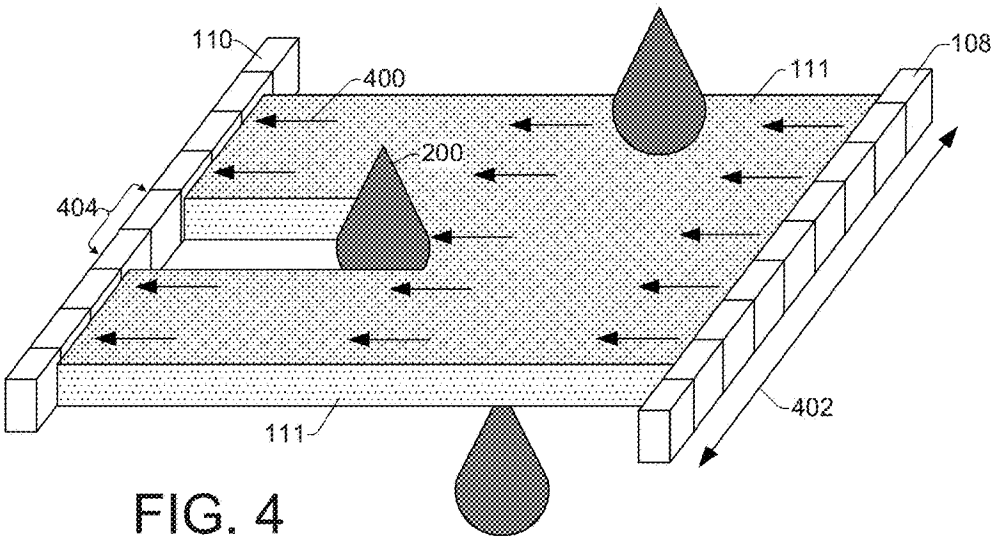
FIG. 4 shows an example of an illumination array and detection array as a fluid drop blocks light emitted from the illumination array.

This is demonstrated more clearly in FIG. 4, which shows an example of a fluid drop 200 passing through the light 111 that is emitted by the illumination array 108 and directed across the print bar 100 toward a detection array 110 in the direction of arrows 400. Note that the print bar 100 itself is not shown in FIG. 4, but that FIG. 4 shows only an illumination array 108, a detection array 110, light 111 from the illumination array 108, and fluid drops 200, which is intended to help demonstrate how portions of the light 111 are blocked by fluid drops 200. As shown in FIG. 4, while a fluid drop 200 blocks some of the light 111 from illumination array 108, additional light which is emitted along the length 402 of the illumination array 108 both in front of and behind the fluid drop 200, is not being blocked. Thus, the detection array 110 senses when and where light 111 is blocked, as fluid drops 200 are ejected from nozzles 124 along the length 402 of the print bar 100. In FIG. 4, a section 404 of the detection array 110 does not receive the portion of light 111 being blocked. This sensed absence of light provides an indication that a fluid drop 200 has been successfully ejected from a particular nozzle at a particular time, and enables a determination to be made that the nozzle is a healthy nozzle. Conversely, when the detection array 110 senses light where light should have been blocked by an expected fluid drop, a determination can be made that a nozzle associated with the expected fluid drop is a defective nozzle because the drop is absent. The time and location of the missing fluid drop can be analyzed by a printer controller, for example, to determine which nozzle is defective. This determination enables corrective action to be taken to mitigate potential missing nozzle print defects that may result from the defective nozzle.

Figure 5:
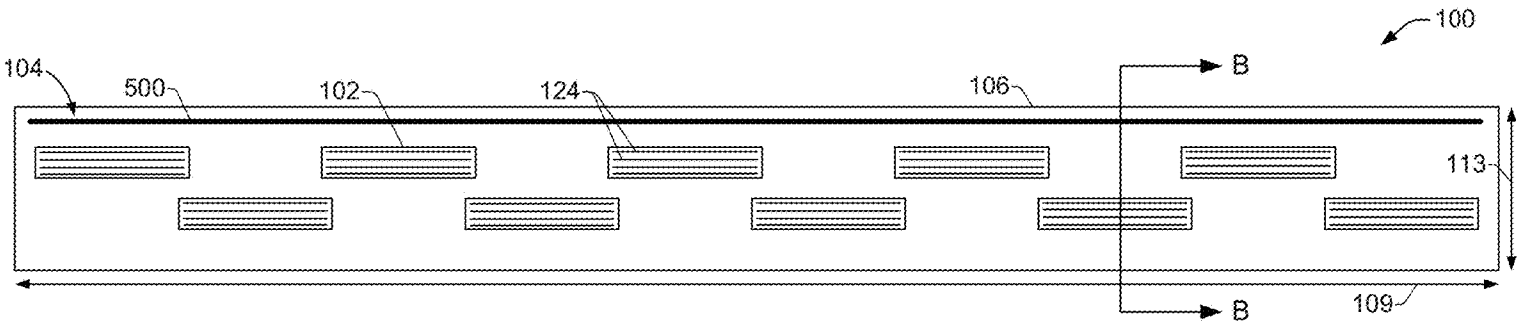
FIG. 5 shows a plan view of an example of a molded inkjet print bar having multiple printhead dies and a nozzle health sensor molded into a monolithic print bar molding.
Figure 6:
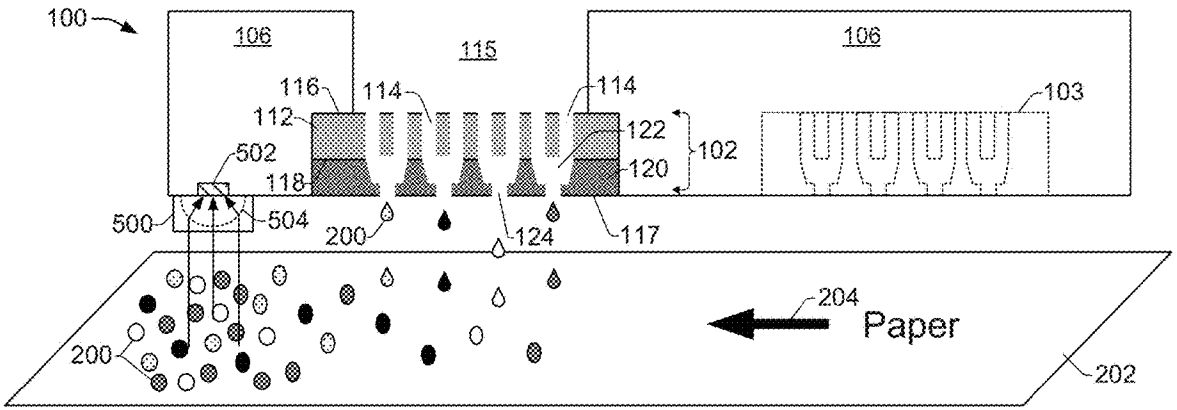
FIG. 6 shows an elevation section view taken across line B-B of the example molded print bar of FIG. 5.

FIG. 5 shows a plan view of another example of a molded inkjet print bar 100 having multiple printhead dies 102 and a nozzle health sensor 104 molded into a monolithic print bar molding 106. In this example, the nozzle health sensor 104 includes an imaging scanner bar 500 for detecting missing dots on print media. FIG. 6 is an elevation section view taken across line B-B of FIG. 5, and shows additional details of the imaging scanner bar 500 and a printhead die 102 integrated into the molding 106 of a molded inkjet print bar 100. Except for the nozzle heath sensor 104, the print bar 100 and printhead dies 102 in FIGS. 5 and 6 are configured in the same general manner as discussed above with respect to FIGS. 1 and 2.

In general, scanner 500 operates by shining light at the media page 202 (e.g., paper) after fluid drops 200 have been ejected from a printhead die 102 and have impacted the paper 202. As the paper 202 travels under the scanner 500, a light source (not specifically shown) in the scanner 500 shines light onto the paper 202, and light reflecting from the paper 202 is directed onto an imaging sensor 502 or photosensitive element 502 within the scanner 500. Light reflecting off the paper 202 can be directed to the photosensitive element 502 through optical components 504 such as one or more mirrors and/or lenses inside the scanner bar 500. Different scanner types implement different types of photo sensing technology. The photosensitive element 502 therefore may be implemented using a CCD or CMOS array, a photomultiplier tube (PMT), a contact image sensor (CIS), or another sensing technology. The photosensitive element 502 receives reflected light from the paper 202 and converts levels of brightness into electronic signals that can be processed into a digital image. The digital image can be analyzed by a printer controller, for example, to determine if fluid drops have been deposited onto the paper 202 at expected locations. If a fluid drop is missing from the paper 202 at a location where a drop is expected to appear, an associated nozzle can be identified as a defective nozzle that has either failed to eject the expected fluid drop, or has ejected the fluid drop at an incorrect trajectory and at an incorrect location on the paper 202. This determination enables corrective action to be taken to mitigate potential missing nozzle print defects that may result from the defective nozzle.

Figure 7:
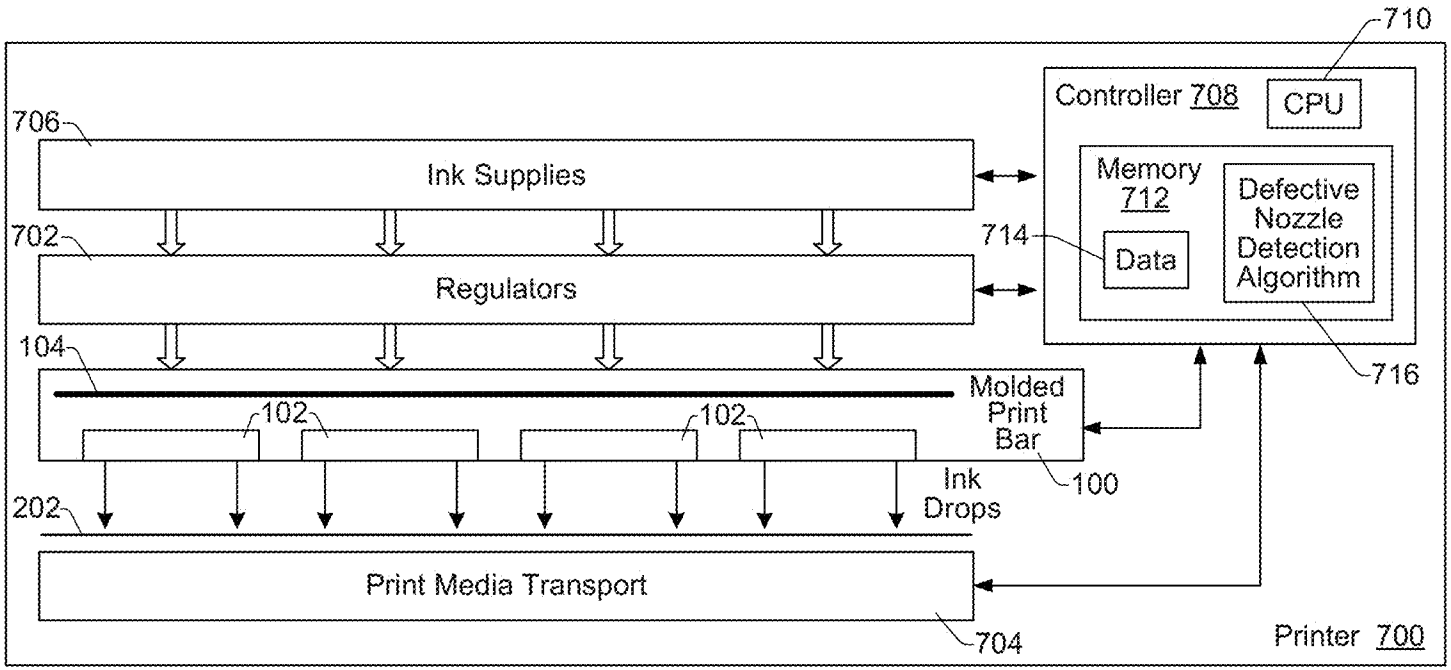
FIG. 7 shows a block diagram of an example page-wide array inkjet printer suitable for implementing a molded inkjet print bar having multiple sliver printhead dies and a nozzle health sensor molded into a monolithic print bar molding.

FIG. 7 is a block diagram illustrating an example of a page-wide array inkjet printer 700 suitable for implementing a molded inkjet print bar 100 having multiple sliver printhead dies 102 and a nozzle health sensor 104 molded into a monolithic print bar molding 106. Printer 700 includes the molded print bar 100 spanning the width of a print media 202 (e.g., paper), flow regulators 702 associated with print bar 100, a media transport mechanism 704, ink or other printing fluid supplies 706, and a printer controller 708. Print bar 100 includes an arrangement of printhead dies 102 for dispensing printing fluid on to a sheet or continuous web of paper or other print media 804. Each printhead die 102 receives printing fluid through a flow path from supplies 706, into and through flow regulators 702, and through fluid channels (not shown) within the print bar 100.

Controller 708 typically includes a processor (CPU) 710, firmware, software, one or more memory components 712, including volatile and non-volatile memory components, and other printer electronics for communicating with and controlling print bar 100, printhead dies 102, nozzle health sensor 104, flow regulators 702, media transport mechanism 704, fluid supplies 706, and operative elements of a printer 700. Controller 708 receives print control data 714 from a host system, such as a computer, and temporarily stores data 714 in a memory 712. Data 714 represents, for example, a document and/or file to be printed. As such, data 714 forms a print job for printer 700 and includes one or more print job commands and/or command parameters.

In one implementation, controller 708 controls printhead dies 102 to eject ink drops from nozzles 124. Thus, controller 708 defines a pattern of ejected ink drops that form characters, symbols, and/or other graphics or images on print media 202. The pattern of ejected ink drops is determined by print job commands and/or command parameters from data 714. In one example, controller 708 includes a defective nozzle detection algorithm 716 stored in memory 712 and having instructions executable on processor 710. The defective nozzle detection algorithm 716 executes to detect defective nozzles in the print bar 100 using information from the nozzle health sensor 104 in conjunction with the print control data 714 which informs the algorithm 716 where and when to expect ejected fluid drops.

For example, when the nozzle health sensor 104 comprises an illumination array 108 and detection array 110 as discussed above with reference to FIGS. 1-4, the detection array 110 senses when and where light from an illumination array 108 is blocked by fluid drops from nozzles 124. The algorithm 716 compares information from the print control data 714 that tells where fluid drops should be expected, to signals from the detection array 110 that indicate the actual presence or absence of fluid drops. Based on this comparison, the algorithm 716 determines the locations of defective nozzles on the printhead dies 102. In another example, where the nozzle health sensor 104 comprises a scanner 500 as discussed above with reference to FIGS. 5 and 6, algorithm 716 receives electronic signals from the scanner 500 and processes them into a digital image. The algorithm 716 then analyzes the digital image and compares the locations of fluid drops from the image to expected locations of fluid drops based on information from the print control data 714. The comparison enables the algorithm 716 to determine the locations of defective nozzles on the printhead dies 102.

Figure 8:
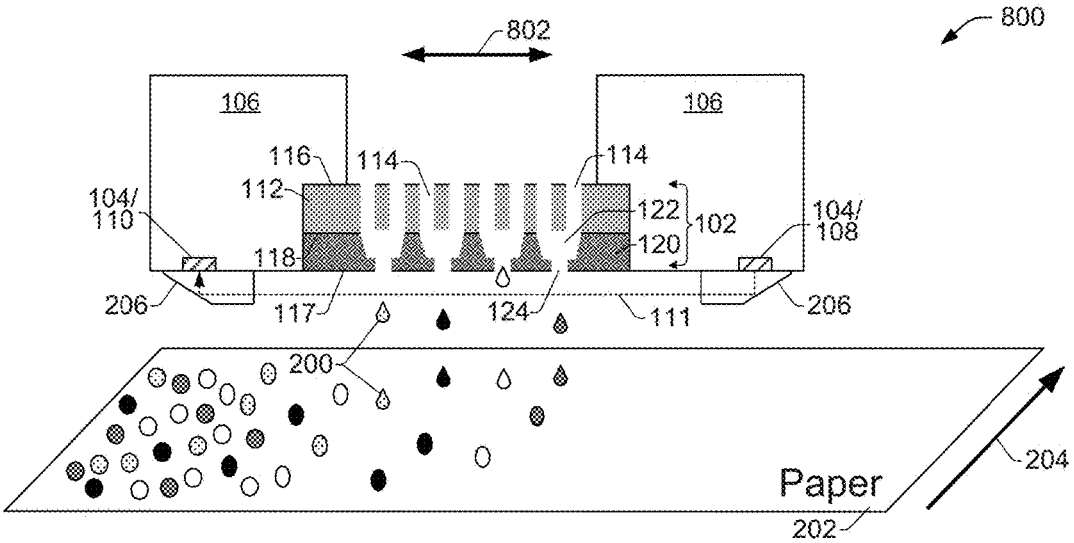
FIG. 8 shows a side sectional view of a molded printhead having a printhead die and components of a nozzle health sensor molded into a molding.

As noted above, the concepts of integrating a nozzle health sensor 104 within a molded inkjet print bar 100 for use in a single-pass, page-wide array inkjet printing device can be applied in a similar manner to the integration of a nozzle health sensor 104 within a molded printhead for use in a multi-pass, scanning inkjet printing device. FIG. 8 shows a side sectional view of a molded printhead 800 having a printhead die 102 and components of a nozzle health sensor 104 molded into the molding 106. While the molded printhead 800 in FIG. 8 incorporates only one printhead die 102, other examples of a molded printhead can include a greater number of printhead dies 102. However, the number of printhead dies 102 on a molded printhead 800 are significantly fewer than would be integrated into a molded print bar 100, and in any case would be appropriate for incorporation onto an inkjet cartridge or pen that scans back and forth across the media/paper 202 in a direction 802 orthogonal to the paper direction 204.

Figure 9:
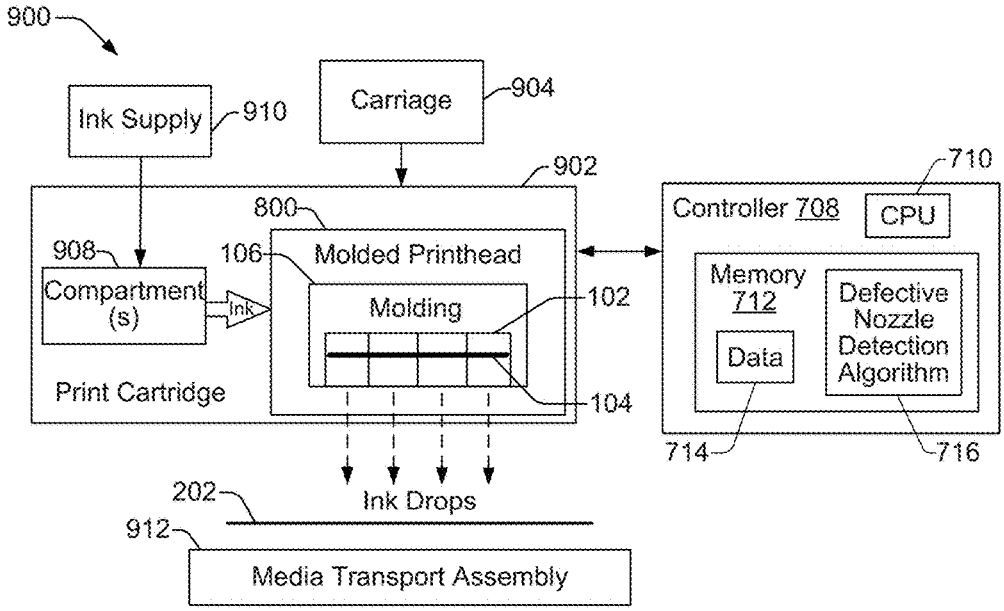
FIG. 9 is a block diagram showing an example inkjet printer with a print cartridge incorporating an example molded printhead having printhead dies and components of a nozzle health sensor molded into a molding.

FIG. 9 is a block diagram showing an example of an inkjet printer 900 with a print cartridge 902 that incorporates one example of a molded printhead 800 having four printhead dies 102 and components of a nozzle health sensor 104 molded into the molding 106. In printer 900, a carriage 904 scans print cartridge 902 back and forth over a print media 202 to apply ink to media 202 in a desired pattern. Print cartridge 902 includes one or more fluid compartments 908 housed together with printhead 800 that receive ink from an external supply 910 and provide ink to printhead 800. In other examples, the ink supply 910 may be integrated into compartment(s) 908 as part of a self-contained print cartridge 902. During printing, a media transport assembly 912 moves print media 202 relative to print cartridge 902 to facilitate the application of ink to media 202 in a desired pattern. Controller 708 operates and is configured in a manner similar to controller 708 discussed above with reference to FIG. 7. Thus, controller 708 generally includes the programming, processor(s), memory(ies), electronic circuits and other components appropriate to control the operative elements of printer 900. In particular, controller 708 includes defective nozzle detection algorithm 716 in memory 712 that includes instructions executable on processor 710 to detect defective nozzles in the print bar 100 using information from the nozzle health sensor 104 in conjunction with print control data 714.

Figure 10:
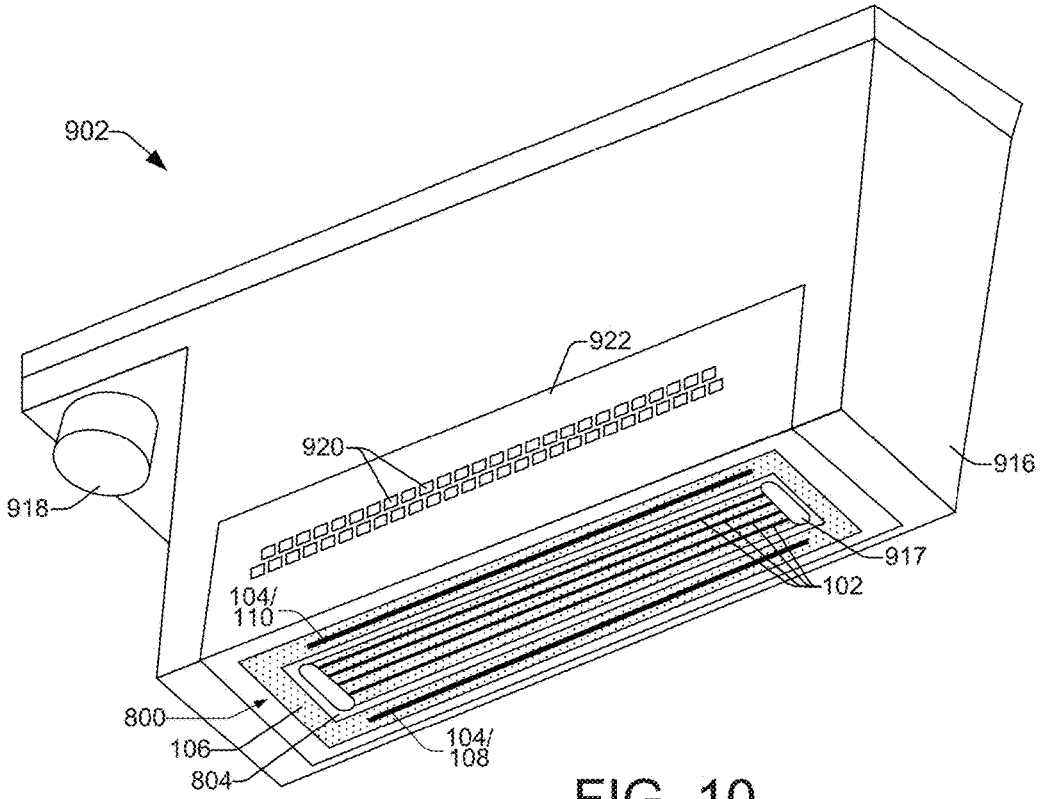
FIG. 10 shows a perspective view of an example print cartridge that includes a molded printhead with printhead dies and a nozzle health sensor molded into a molding.

FIG. 10 shows a perspective view of an example print cartridge 902. Referring to FIGS. 9 and 10, print cartridge 902 includes a molded printhead 800 with four printhead dies 102 and a nozzle health sensor 104 molded into the molding 106 and supported by a cartridge housing 916. Components of nozzle health sensor 104 include an illumination array 108 and a detection array 110. In another example, a nozzle health sensor 104 comprises a scanner 500. Printhead 800 includes four elongated printhead dies 102 and a printed circuit board (PCB) 804 embedded into a molding 106. In the example shown, the printhead dies 102 are arranged parallel to one another across the width of printhead 800, within a window that has been cut out of the PCB 804. While the illustrated print cartridge 902 has a single printhead 800 with four dies 102, other configurations are possible, such as cartridges having multiple printheads 800, each with more or less dies 102. At either end of the printhead dies 102 are bond wires (not shown) covered by low profile protective coverings 917 comprising a suitable protective material such as an epoxy, and a flat cap placed over the protective material.

Print cartridge 902 is fluidically connected to ink supply 910 through an ink port 918, and is electrically connected to controller 708 through electrical contacts 920. Contacts 920 are formed in a flex circuit 922 affixed to the housing 916. Signal traces (not shown) embedded in flex circuit 922 connect contacts 920 to corresponding contacts (not shown) on printhead 800. Ink ejection nozzles 124 (not shown in FIGS. 9 and 10) on each printhead die 102 are exposed through an opening in flex circuit 922 along the bottom of cartridge housing 916.

Figure 11:
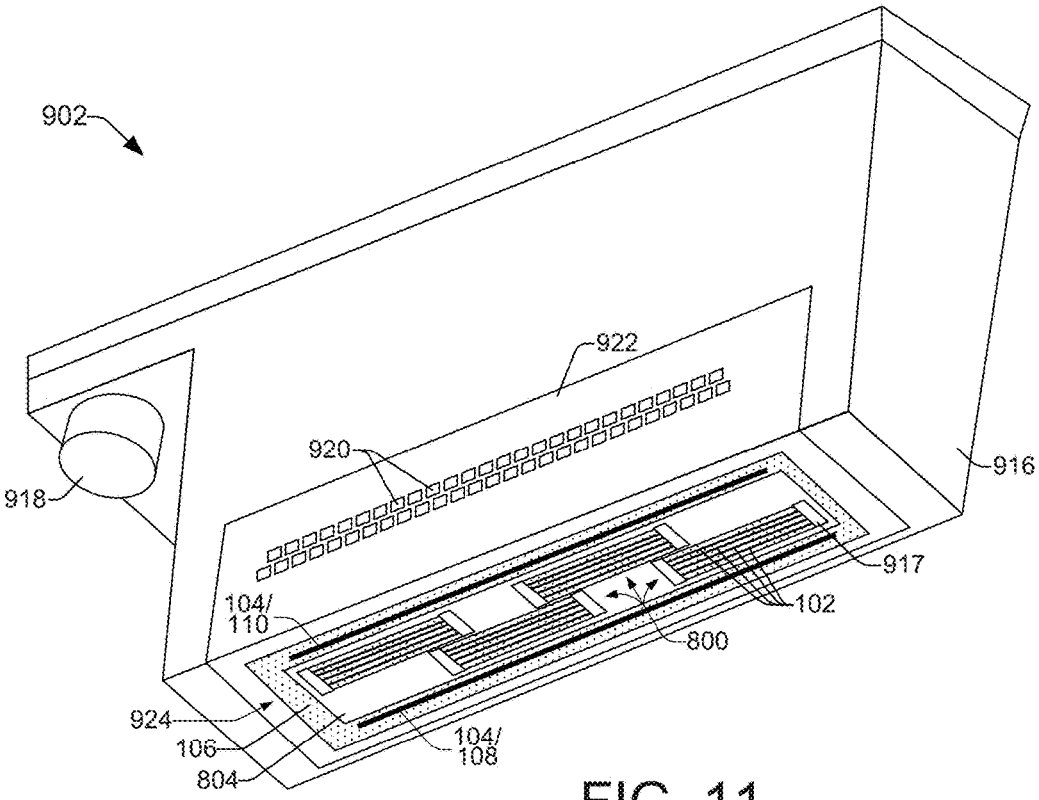
FIG. 11 shows a perspective view of another example print cartridge suitable for use in a printer.

FIG. 11 shows a perspective view of another example print cartridge 902 suitable for use in a printer 900. In this example, the print cartridge 902 includes a printhead assembly 924 with four printheads 800 and a PCB 804 embedded in a molding 106 and supported by cartridge housing 916. Also embedded in the molding 106 of assembly 924 is a nozzle health sensor 104. Components of nozzle health sensor 104 include an illumination array 108 and a detection array 110. In another example, a nozzle health sensor 104 comprises a scanner 500. Each printhead 800 includes four printhead dies 102 located within a window cut out of the PCB 804. While a printhead assembly 924 with four printheads 800 is shown for this example print cartridge 902, other configurations are possible, for example with more or fewer printheads 100 that each have more or fewer dies 102. At either end of the printhead dies 102 in each printhead 800 are bond wires (not shown) covered by low profile protective coverings 917 comprising a suitable protective material such as an epoxy, and a flat cap placed over the protective material. As in the example cartridge 902 shown in FIG. 10, an ink port 918 fluidically connects cartridge 902 with ink supply 910 and electrical contacts 920 electrically connect printhead assembly 924 of cartridge 902 to controller 708 through signal traces embedded in flex circuit 922. Ink ejection nozzles 124 (not shown in FIG. 11) on each printhead die 102 are exposed through an opening in the flex circuit 922 along the bottom of cartridge housing 916.

What is claimed is:

1. A print cartridge comprising:

a monolithic molding;

a printhead die embedded into the molding, the printhead die having a front surface exposed outside the molding to dispense fluid drops through nozzles and an opposing back surface covered by the molding except at a channel in the molding through which fluid is to pass directly to the back surface; and a nozzle health sensor molded into the molding to detect defective nozzles in the printhead die.

2. The print cartridge of claim 1, wherein the nozzle health sensor comprises:

a light illuminator molded into the molding;

an optical detector molded into the molding to sense light emitted by the light illuminator.

3. The print cartridge of claim 2, wherein the optical detector comprises an imaging sensor selected from the group consisting of a charge coupled device (CCD), a complementary metal oxide semiconductor (CMOS) device, a photomultiplier tube (PMT), a contact image sensor (CIS), and a photodiode.

4. The print cartridge of claim 2, wherein the light illuminator comprises a light emitting diode.

5. The print cartridge of claim 1, wherein the nozzle health sensor comprises:

an illumination array molded into a first side of the molding;

a detection array molded into a second side of the molding to sense light emitted by the illumination array; and an optical component to direct light emitted by the illumination array across the front surface of the printhead die to the detection array.

6. The print cartridge of claim 5, wherein the optical component comprises:

an optical component associated with the illumination array; and an optical component associated with the detection array.

7. The print cartridge of claim 5, wherein the optical component is selected from the group consisting of a collimator, a mirror, a lens, and a combination thereof.

8. The print cartridge of claim 1, wherein the nozzle health sensor comprises a scanner to illuminate a media page onto which the fluid drops have been dispensed and to sense light reflected off the media page to determine where fluid drop dots are missing.

9. The print cartridge of claim 8, wherein the scanner comprises:

a photosensitive element to receive light reflected off the media page and convert the light into electronic signals to enable formation of a digital image; and an optical component to direct the light reflected off the media page to the photosensitive element.

10. The print cartridge of claim 9, wherein the photosensitive element is selected from the group consisting of a charge coupled device (CCD), a complementary metal oxide semiconductor (CMOS) device, a photomultiplier tube (PMT), a contact image sensor (CIS), and a photodiode.

11. The print cartridge of claim 1, wherein the printhead die comprises:

a silicon substrate;

a fluidics layer formed on the substrate having fluid ejection chambers, each chamber associated with a nozzle; and fluid feed holes in the substrate to enable fluid to pass from the channel through the substrate into the fluid ejection chambers.

12. The print cartridge of claim 1, wherein the monolithic molding is a monolithic body of moldable material.

13. The print cartridge of claim 1, further comprising:

a cartridge housing that supports the molding.

14. A print cartridge comprising:

a housing to contain a printing fluid; and a printhead supported by the housing and comprising:

a monolithic molding;

a printhead die embedded in the molding, the printhead die having a back surface partially covered by the molding, and an exposed front surface having nozzles in the printhead die to eject fluid drops, the molding mounted to the housing and having a channel through which fluid is to pass to the back surface of the printhead die; and a nozzle health sensor comprising an optical detector, the nozzle health sensor molded into the molding to detect defective nozzles in the printhead die.

15. The print cartridge of claim 14, wherein the monolithic molding is a monolithic body of moldable material.

16. The print cartridge of claim 14, wherein the nozzle health sensor further comprises a light illuminator to emit light for detection by the optical detector.

17. The print cartridge of claim 16, wherein the light illuminator comprises a light emitting diode.

18. The print cartridge of claim 16, further comprising a mirror to guide the light from the light illuminator to the optical detector.

19. The print cartridge of claim 16, wherein the light illuminator is provided on a first side of the printhead die, and the optical detector is provided on an second different side of the printhead die.

20. The print cartridge of claim 14, wherein the optical detector is selected from the group consisting of a charge coupled device (CCD), a complementary metal oxide semiconductor (CMOS) device, a photomultiplier tube (PMT), a contact image sensor (CIS), and a photodiode.

* * * * *